US008845312B2

(12) United States Patent
Takaki

(10) Patent No.: US 8,845,312 B2
(45) Date of Patent: Sep. 30, 2014

(54) SCREW COMPRESSOR

(75) Inventor: Shugo Takaki, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 73 days.

(21) Appl. No.: 13/296,734

(22) Filed: Nov. 15, 2011

(65) Prior Publication Data

US 2012/0148435 A1 Jun. 14, 2012

(30) Foreign Application Priority Data

Dec. 10, 2010 (JP) ..... 2010-275964

(51) Int. Cl.

| | |
|---|---|
| ***F01C 1/16*** | (2006.01) |
| ***F04C 29/02*** | (2006.01) |
| ***F04C 18/08*** | (2006.01) |
| ***F04C 18/16*** | (2006.01) |

(52) U.S. Cl.

CPC ..... *F04C 18/16* (2013.01); *F04C 29/028* (2013.01); *F04C 18/086* (2013.01); *F04C 2240/806* (2013.01)

USPC ..... 418/201.1

(58) Field of Classification Search

CPC .. F04C 2240/806; F04C 29/028; F04C 18/16; F04C 18/086

USPC ..... 418/1, 87, 97, 104, 201.1, DIG. 1, 83, 418/98–100, 200, 206.6, 206.7, 206.8; 62/505

See application file for complete search history.

(56) References Cited

U.S. PATENT DOCUMENTS

| | | | | | |
|---|---|---|---|---|---|
| 4,575,322 | A | * | 3/1986 | Paquet et al. | 418/96 |
| 5,273,412 | A | * | 12/1993 | Zwaans | 418/97 |
| 5,469,716 | A | * | 11/1995 | Bass et al. | 62/505 |
| 5,490,771 | A | * | 2/1996 | Wehber et al. | 418/104 |
| 5,697,771 | A | * | 12/1997 | Arndt et al. | 418/15 |
| 5,727,936 | A | * | 3/1998 | Eriksson et al. | 418/88 |
| 5,911,743 | A | * | 6/1999 | Shaw | 62/84 |

(Continued)

FOREIGN PATENT DOCUMENTS

| | | |
|---|---|---|
| CN | 1336986 | 2/2002 |
| EP | 1 975 411 A1 | 10/2008 |

(Continued)

OTHER PUBLICATIONS

European Office Action issued Feb. 13, 2013 in Patent Application No. 11 190 464.5.

(Continued)

*Primary Examiner* — Kenneth Bomberg
*Assistant Examiner* — Jason T Newton
(74) *Attorney, Agent, or Firm* — Oblon, Spivak, McClelland, Maier & Neustadt, L.L.P.

(57) ABSTRACT

Provided is a screw compressor, accommodating a pair of rotatable male and female screw rotors in a compression chamber formed in a casing, wherein the casing includes: an internal dividing wall that defines an inside interior space; and an outer wall that defines an outside interior space arranged outside the inside interior space The screw compressor further includes: a communication pipe member that penetrates the outer wall and extends across the outside interior space, and an end of the communication pipe member being inserted into the internal dividing wall so that the inside interior space communicates with a passage outside the outer wall. By using this communication pipe member, fluid can pass across an interior space in the casing to be fed to another interior space formed further inside.

2 Claims, 4 Drawing Sheets

(56) References Cited

U.S. PATENT DOCUMENTS

| | | | | |
|---|---|---|---|---|
| 6,293,776 | B1 | 9/2001 | Hahn et al. | |
| 6,612,820 | B1 | 9/2003 | Staat et al. | |
| 2008/0240963 | A1 | 10/2008 | Kimura et al. | |
| 2011/0135528 | A1 * | 6/2011 | Amano | 418/206.6 |

FOREIGN PATENT DOCUMENTS

| | | | |
|---|---|---|---|
| FR | 2 100 405 | | 3/1972 |
| JP | 3-71187 | U | 7/1991 |
| JP | 6-159272 | A | 6/1994 |
| JP | 2005-171959 | A | 6/2005 |
| JP | 2005-214010 | A | 8/2005 |
| JP | 4365443 | | 8/2009 |
| WO | WO 00/42322 | | 7/2000 |

OTHER PUBLICATIONS

Japanese Office Action issued Jan. 29, 2013 in Patent Appliation No. 2010-275964 with English Translation.

The Extended European Search Report issued Sep. 3, 2012, in Application No. / Patent No. 11190464.5-2315 / 2463526.

* cited by examiner

SCREW COMPRESSOR

BACKGROUND OF THE INVENTION

1. Field of the Invention

The present invention relates to a screw compressor.

2. Description of the Related Art

A screw compressor that accommodates a pair of male and female rotors in a compression chamber (rotor chamber) formed in a casing, and that compresses gas drawn from a suction passage by the rotation of the rotors and discharges the compressed gas from a discharge passage is widely used.

Bearings that support rotor shafts of a pair of male and female screw rotors, and shaft sealing members disposed around the rotor shafts to isolate a compression chamber from the other space are necessarily provided for a screw compressor. The bearings are generally fed with lubrication oil. When non-contacting sealing such as dry gas seal is used for shaft sealing parts, so-called seal gas needs to be fed to the shaft sealing parts in many cases. In addition, fluid (e.g., air) compression may generate so-called drain. Therefore, in many screw compressors, passages for feeding oil and gas to their inside and passages for discharging the oil and gas, the drain that is generated in their inside and the like are formed.

For example, Japanese Patent No. 4365443 discloses a screw compressor configured such that oil stored in an oil tank is fed to plural bearings and mechanical seals via an oil feed line including an oil cooler, a pump and a filter. In this screw compressor, in order to form passages that feed lubrication oil to the bearings that support shafts of the screw rotors, a portion of a casing that supports bearings and an outer wall portion thereof are partially and integrally connected in the radial direction.

As in the screw compressor disclosed in the above patent, it is not structurally unnatural to connect the portion that supports the bearings and the outer wall in the radial direction. However, since screw compressors are designed according to various demands, in some screw compressors, the internal portion of the casing and the outer wall portion thereof are not necessarily connected in the radial direction in terms of strength. In some cases, it is more preferable to form passages used for sucking gas into a compression chamber, or to form, in the outside of the bearing, a space that stores a fluid different in kind or pressure from bearing oil, for example, a space that stores oil for lubricating gears that synchronize male and female screw rotors.

A casing of a screw compressor is generally formed by the casting. Although passages and other parts are formed only for passage of a small amount of fluid, passages and other parts that are formed by the casting may not have sufficient thickness in some cases. In these cases, molten metal may not sufficiently spread and may not become desired shape. As a result, the formed passages may communicate with other interior spaces due to insufficient wall thickness. In addition, since the cooling speed becomes uneven, material defects may be caused, resulting in breakage. Therefore, for conventional screw compressors, an internal portion of a casing and an outer wall portion are integrally formed in the radial direction only for securing fluid passages, even if there is no mechanical requirement. Thus, the casing becomes heavy and large.

Problems to be Solved by the Invention

In consideration of the above problems, it is an object of the present invention to provide a small and light-weight screw compressor, in which fluid can pass across an interior space in a casing to be fed to another interior space formed further inside of the interior space.

SUMMARY OF THE INVENTION

To solve the problems, the present invention provides a screw compressor, accommodating a pair of rotatable male and female screw rotors in a compression chamber formed in a casing, wherein the casing includes: an internal dividing wall that defines an inside interior space; and an outer wall that defines an outside interior space arranged outside the inside interior space, and the screw compressor further includes: a communication pipe member that penetrates the outer wall and extends across the outside interior space, and an internal end of the communication pipe member being inserted into the internal dividing wall so that the inside interior space communicates with a passage outside the outer wall.

According to this configuration, since a pipe member for feeding fluid to the inside interior space is a member that is separate from a casing main body, the pipe member can be made of a thin material, and the screw compressor is easily made smaller and more light-weight.

In the screw compressor of the present invention, the communication pipe member may include a flange closely contacted with an outer surface of the outer wall via a gasket, the internal end of the communication pipe member may fit into a fitting hole formed through the internal dividing wall, and an O-ring may be disposed between the circumference of the communication pipe member and the fitting hole.

According to this configuration, since there is some degree of freedom-in fixation of the flange to the outer wall using the gasket, concentric misalignment between the fitting hole of the internal dividing wall and the through hole of the outer wall can be absorbed, and air-tightness of the inside interior space and the outside interior space can be easily secured. In addition, since welding or the like is not needed to fix the communication pipe member to the casing, strain or the like is not caused by heat, and cracks are thus less likely to be generated.

In the screw compressor of the present invention, the screw compressor may further include a shaft sealing device, and the inside interior space may form a bearing space. Here, the outside interior space may form a suction space.

DETAILED DESCRIPTION OF THE PREFERRED EMBODIMENT

Figure 1:
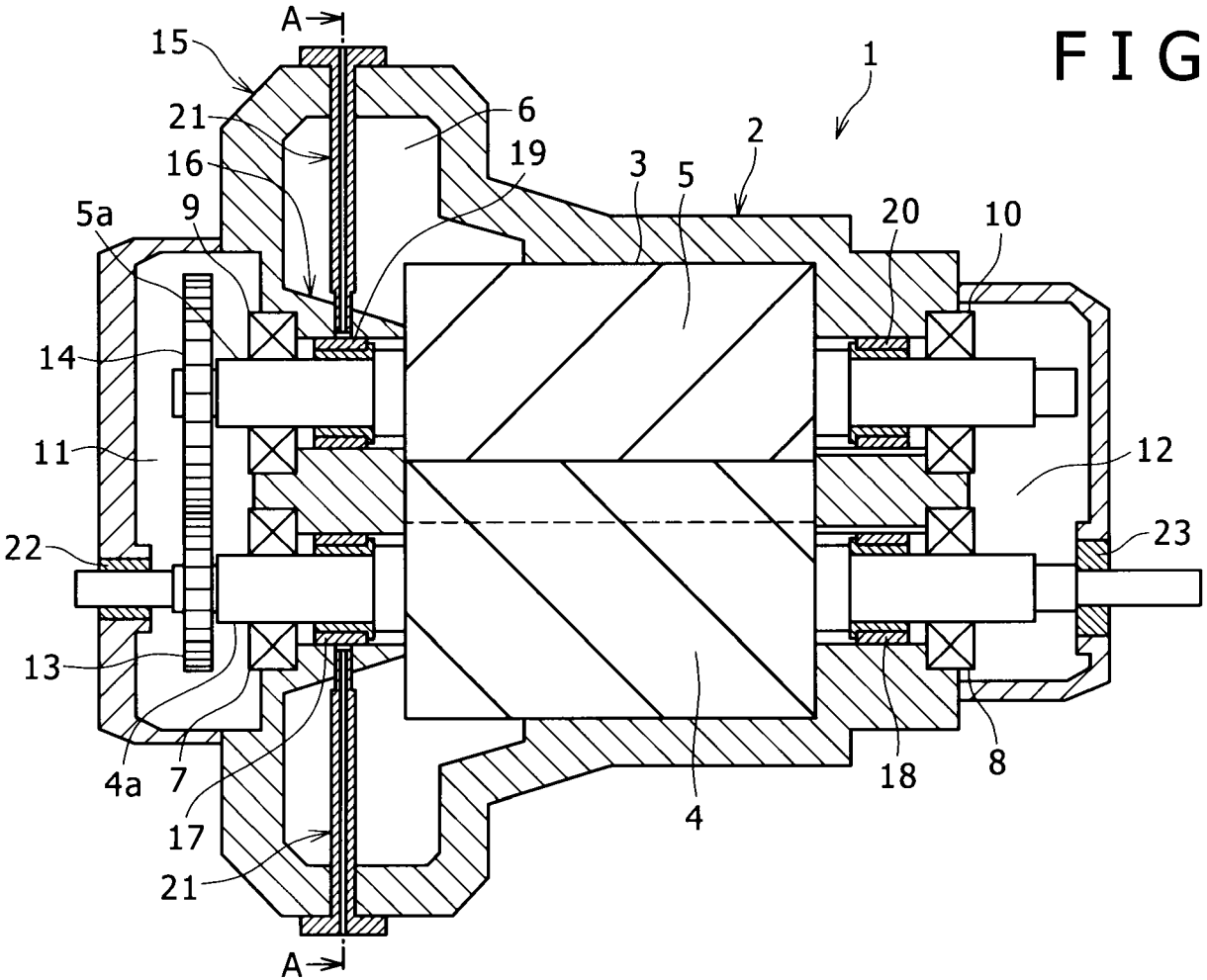
FIG. 1 is a cross-sectional view of a screw compressor of a first embodiment of the present invention along its shaft.
Figure 2:
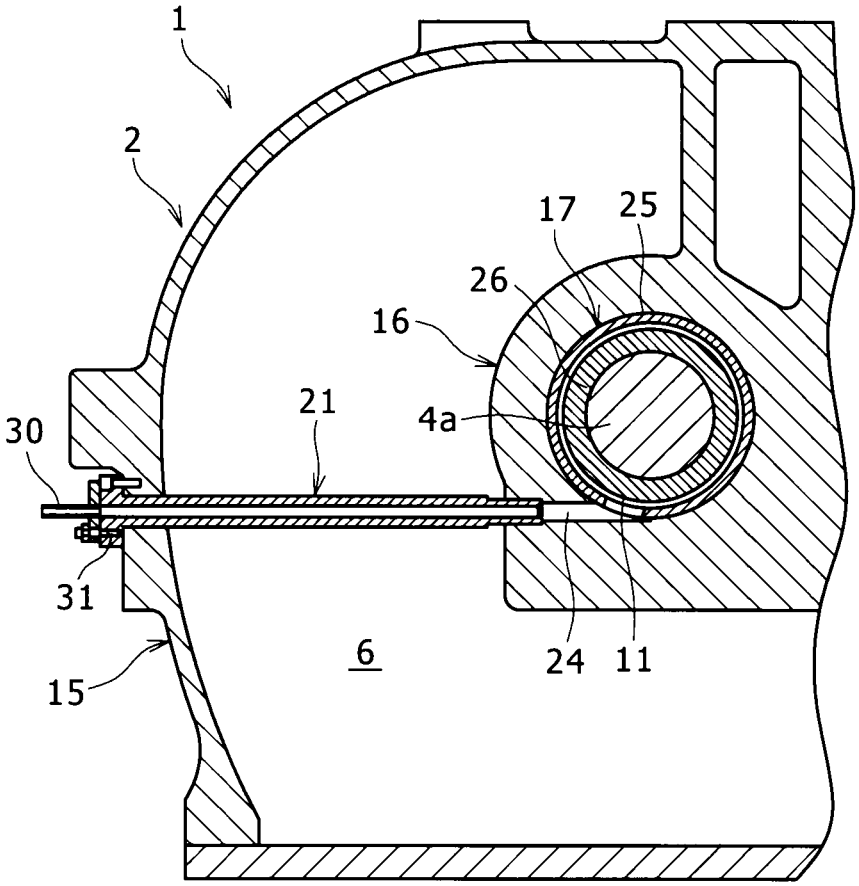
FIG. 2 is a cross-sectional view of the screw compressor in FIG. 1 along the direction perpendicular to the shaft.

A screw compressor of an embodiment of the present invention is now described with reference to accompanying drawings. FIG. 1 shows a cross-section of the whole of a compressor 1 of a first embodiment of the present invention along the shaft of the screw rotor thereof. FIG. 2 shows a cross-section along the line A-A of FIG. 1, i.e., a partial cross-section of the screw compressor 1 along a direction perpendicular to the shaft.

The screw compressor 1 of the present embodiment accommodates a pair of rotatable male and female screw rotors (male rotor 4 and female rotor 5) in a compression chamber 3 formed in a casing 2 composed of a casting. The casing 2 defines a suction space (outside interior space) 6 that communicates with the compression chamber 3 and to which a suction pipe (not shown) is connected, and bearing spaces (inside interior spaces) 11 and 12 that accommodate bearings 7 to 10 that support shafts 4*a* and 5*a* of the screw rotors 4 and 5. The suction-side bearing space 11 also accommodates gears 13 and 14 that rotate the male and female rotors 4 and 5 in a synchronized manner.

The suction space 6 and the bearing spaces 11 and 12 are isolated by an internal dividing wall 16 that is a part of the casing 2 integrally cast with the internal dividing wall 16 and that extends toward the compression chamber 3 from an outer wall 15 that defines an outer part of the suction space 6. Between the internal dividing wall 16 and the shafts 4*a* and 5*a* of screw rotors 4 and 5, shaft sealing devices 17 to 20 are disposed to isolate the compression chamber 3 from the bearing spaces 11 and 12.

In addition, approximately tubular communication pipe members 21 are placed in the casing 2 in such a manner that the members 21 penetrate the outer wall 15 and extend across the suction space 6, and an end of the members 21 is inserted into the internal dividing wall 16. Via the communication pipe members 21, the bearing space 11 can communicate with a pipe line that is outside the casing 2 and feed shaft seal gas.

In the screw compressor 1 of the present embodiment, the suction-side shaft 4*a* of the male rotor 4 extends to the outside of the casing 2 to be connected to a motor (not shown) or the like. Likewise, the discharge-side shaft 4*a* of the male rotor 4 also extends to the outside of the casing 2, and a mechanism such as a tilting pad (not show) is provided to receive thrust load. Therefore, the portions of the casing 2 where the shafts 4*a* of the male rotor 4 penetrate the casing 2 are provided with shaft sealing devices 22 and 23.

As shown in FIG. 2, an end of each communication pipe member 21 is inserted into a fitting hole 24 formed through the internal dividing wall 16. The fitting hole 24 is through the internal dividing wall 16 and opens into the bearing space 11 so that the fitting hole 24 becomes a passage that feeds the shaft seal gas to the shaft sealing device 17 or 19. The shaft sealing devices 17 and 19 are, for example, dry gas seal that the shaft seal gas is fed to a narrow space between the rotor 26 air-tightly mounted to the shaft of the screw rotor 4 and the stator 25 air-tightly mounted to the internal dividing wall. The shaft sealing devices 17 and 19 prevent gas compressed in the compression chamber 3 from leaking into the bearing space 11, using the pressure of the shaft seal gas.

Figure 3:
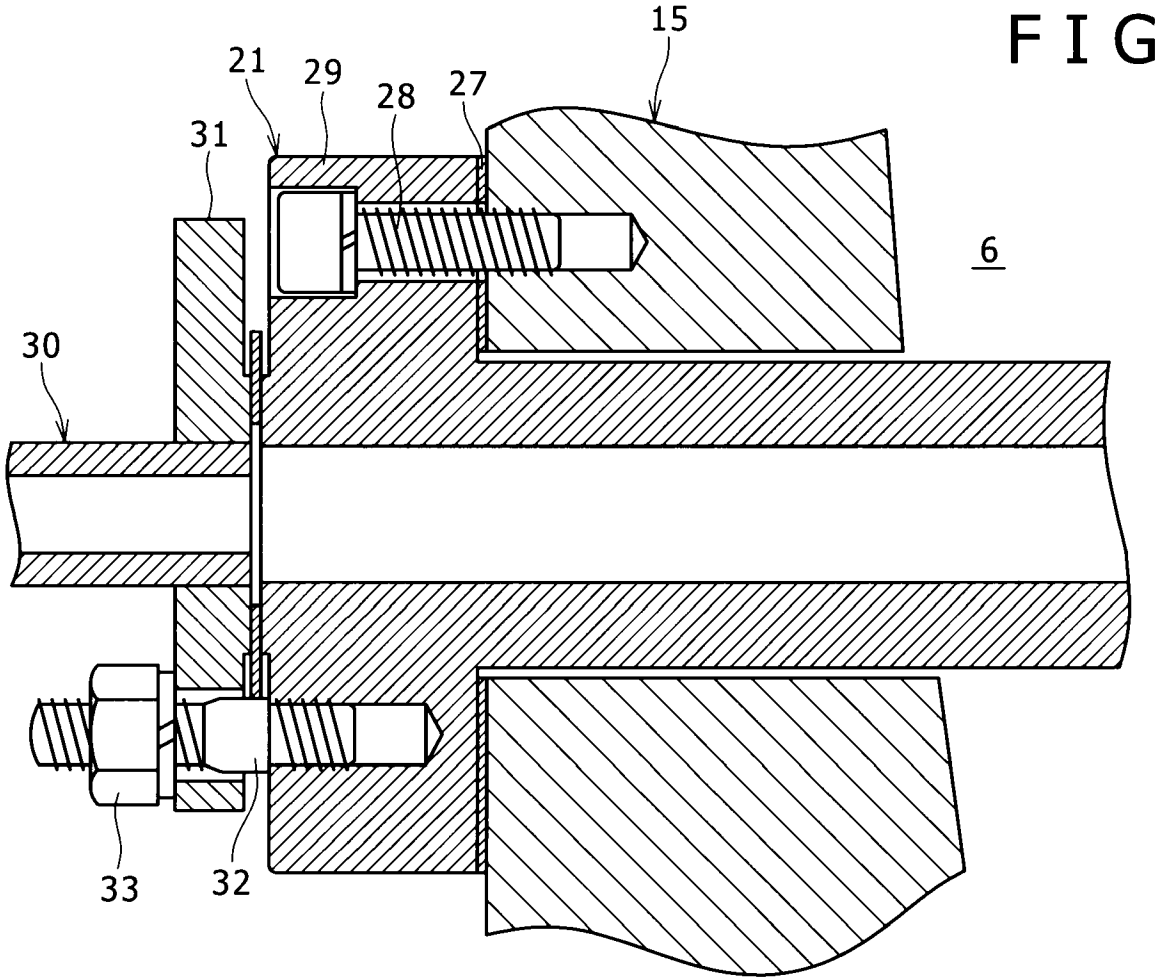
FIG. 3 is a partial cross-sectional view of a communication pipe member in FIG. 2 near a flange.

As shown in FIG. 3, each communication pipe member 21 includes a flange 29 that is closely contacted with an outer surface of the outer wall 15 of the casing 2 via a gasket 27 and fixed thereto with screws 28. A flange 31 of an external pipe 30 feeding the shaft seal gas is fixed to the flange 29 using a stud bolt 32 and a nut 33.

Figure 4:
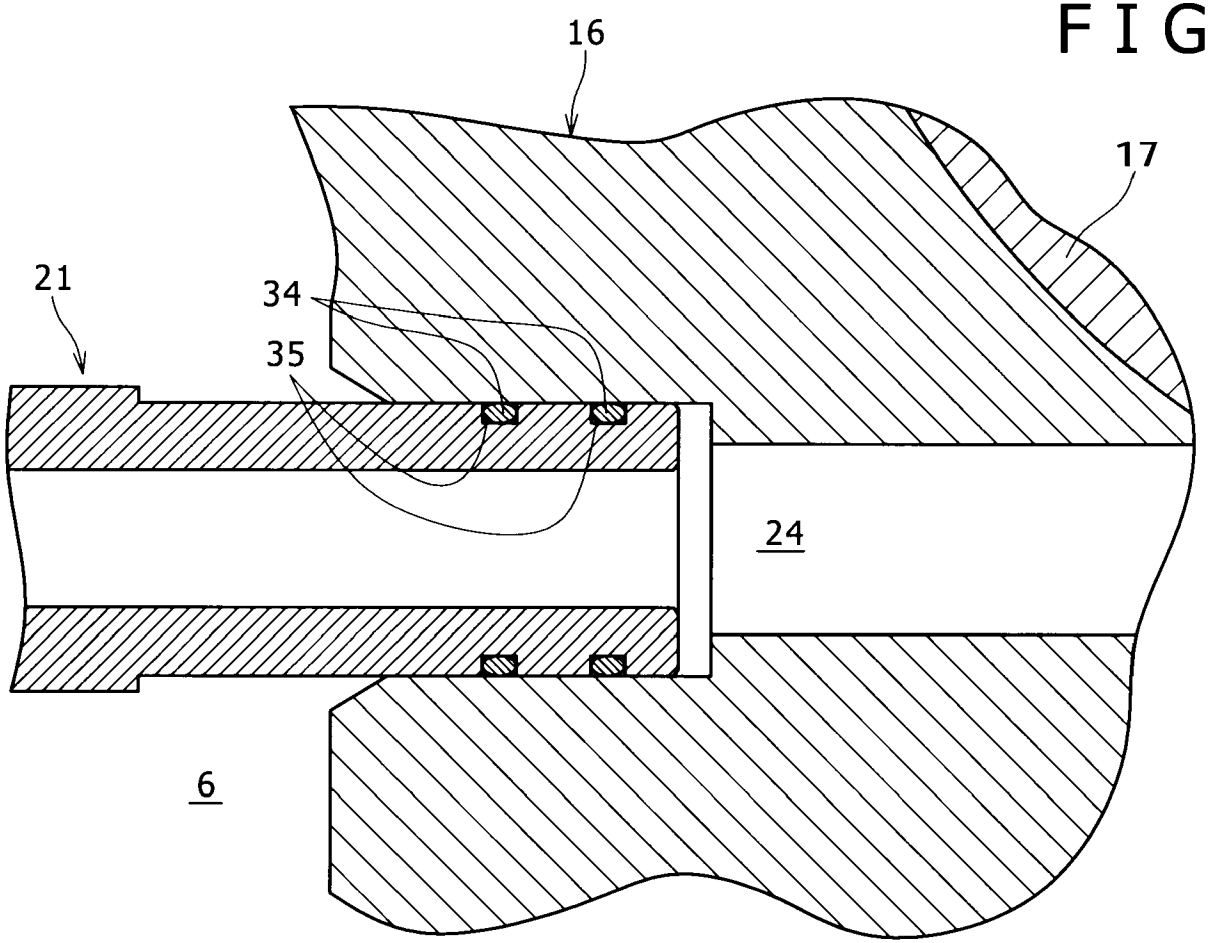
FIG. 4 is a partial cross-sectional view of the communication pipe member in FIG. 2 near its end.

As shown in FIG. 4, ring grooves 35 are formed on the circumference of each communication pipe member 21 near its end to receive O-rings 34 for sealing a gap between the communication pipe member 21 and the fitting hole 24 of the internal dividing wall 16. A suction space 6-side opening of the fitting hole 24 is tapered so that the communication pipe member 21 is easily inserted.

If an end of the communication pipe member 21 is not strictly concentric relative to the fitting hole 24, it cannot be inserted into the fitting hole 24. With respect to the flange 29 of the other end, however, since it is fixed to the outer wall 15 of the casing 2 via the gasket 27, it can be air-tightly fixed to the outer wall 15 even if it is slightly not concentric or inclined relative to a through hole of the outer wall 15. Since this prevents the communication pipe member 21 from experiencing excessive stress that may cause cracks, the passage for the shaft seal gas is formed such that it is completely isolated from the suction space 6.

According to the present invention, a communication pipe member consisting of only a straight pipe may be fixed to a casing 2 composed of a casting by welding the entire circumference of the communication pipe member in order not to leave gaps between them. However, if the flange 29 that is fixed to the outer wall 15 via the gasket 27 is provided as in the present embodiment, there is no strain due to welding heat and the communication pipe member 21 is less likely to be damaged.

Since the communication pipe member 21 is removable in the present embodiment, it can be easily replaced even if it is unexpectedly damaged.

The communication pipe member 21 can be formed by machining such as machining a metal material. Thus, since the communication pipe members 21 is free from defects in material as seen in a casting, it has sufficient strength even in case of thin wall thickness and its high dimensional accuracy can be expected. Therefore, the communication pipe member 21 thus separately formed is small and light-weight and does not narrow the suction space, compared with a case in which a passage for the shaft seal gas is formed through a part of a casting that is integral with a casing 2 Thus, the communication pipe member 21 does not make the screw compressor 1 larger or heavier. In addition, since the communication pipe member 21 has a great degree of freedom in the geometry and the like, its character frequency can be appropriately adjusted to suppress vibration.

Although, in the present embodiment, the communication pipe member 21 is used to form a passage that feeds the shaft seal gas to the shaft sealing device 17 or 19, the configuration of the communication pipe member 21 may be widely applied also to form a passage that moves fluid between the outside of the casing and an inside interior space in a casing that is provided further inside of an outside interior space.

According to the present invention, various passages can be formed, for example, a passage for feeding lubrication oil to a bearing, a passage for recovering lubrication oil from a bearing, a passage for recovering cooling oil leaked from a compression chamber to a shaft sealing device, a passage for feeding liquid such as oil to a sealing surface of a shaft sealing device such as a mechanical seal, and a passage for discharging drain.

What is claimed is:

1. A screw compressor comprising:

a casing defining an interior space and a compression chamber in the casing;

a pair of rotatable engaging screw rotors accommodated in the compression chamber;

an internal dividing wall in the casing that divides the interior space into an inside interior space comprising a bearing space and an outside interior space arranged outside said inside interior space; and an outer wall that exteriorly defines the outside interior space, wherein said outer wall has a hole extending therethrough;

a communication pipe member that penetrates entirely through said hole of said outer wall and is separate from said outer wall such that the communication pipe member can be removed from said casing via said hole of said outer wall, wherein said communication pipe member extends across said outside interior space and an internal end of said communication pipe member is inserted into said internal dividing wall so that said inside interior space communicates with a region exterior to said outer wall, wherein said communication pipe member includes a flange closely contacted with an outer surface of said outer wall via a gasket, said internal end of said communication pipe member fits into a fitting hole formed through said internal dividing wall;

a shaft sealing device and an O-ring is disposed between the circumference of said communication pipe member and the wall of said fitting hole.

2. The screw compressor according to claim 1, wherein said outside interior space forms a suction space.

* * * * *